United States Patent [19]

Koch et al.

[11] Patent Number: 4,816,038

[45] Date of Patent: Mar. 28, 1989

[54] METAL COMPLEXES OF MANNICH BASES WITH A SCHIFF BASE

[75] Inventors: Frederick W. Koch, Willoughby Hills; Gail A. Evans, Euclid; Casper J. Dorer, Jr., Lyndhurst, all of Ohio; Alan A. Del Paggio, Houston, Tex.

[73] Assignee: The Lubrizol Corporation, Wickliffe, Ohio

[21] Appl. No.: 159,100

[22] Filed: Feb. 23, 1988

Related U.S. Application Data

[63] Continuation-in-part of Ser. No. 779,725, Sep. 24, 1985, abandoned.

[51] Int. Cl.[4] ..... C10L 1/18; C10L 1/22

[52] U.S. Cl. ..... 44/68; 44/73; 556/32; 556/33; 556/110; 556/113

[58] Field of Search ..... 44/68, 73; 556/32, 33, 556/110, 113

[56] References Cited

U.S. PATENT DOCUMENTS

| | | | |
|---|---|---|---|
| 3,169,988 | 2/1965 | Luvisi | 44/73 |
| 3,574,837 | 4/1971 | Pacheco et al. | 424/248 |
| 3,649,659 | 3/1972 | Otto et al. | 44/68 |
| 3,875,200 | 4/1975 | L'Eplattenier et al. | 260/439 R |
| 3,877,889 | 4/1975 | Dix | 44/73 |
| 3,945,933 | 3/1976 | Chibnik et al. | 252/33.3 |
| 3,988,323 | 10/1976 | L'Eplattenier et al. | 260/439 R |
| 4,029,683 | 6/1977 | Aratani et al. | 260/438.1 |
| 4,044,036 | 8/1977 | Hari et al. | 260/438.1 |
| 4,093,614 | 6/1978 | Chibnik et al. | 260/299 |
| 4,655,949 | 4/1987 | Landry et al. | 252/51.5 R |

FOREIGN PATENT DOCUMENTS

| | | |
|---|---|---|
| 2443017 | 3/1975 | Fed. Rep. of Germany . |
| 794015 | 1/1981 | U.S.S.R. . |

*Primary Examiner*—William R. Dixon, Jr.
*Assistant Examiner*—Ellen McAvoy
*Attorney, Agent, or Firm*—James L. Cordek; Joseph P. Fischer; Robert A. Franks

[57] ABSTRACT

Metal complexes of hydroxyl- and/or thiol-containing Mannich are prepared by reacting a transition metal-containing agent with an aromatic Mannich. The Mannich is prepared from a substituted hydroxyl- and/or thiol-containing aromatic, an aldehyde or ketone, and a hydroxyl- and/or thiol-containing amine compound. A Schiff base is then reacted therewith. The products are useful in reducing soot ignition temperatures in diesel particulate traps.

23 Claims, No Drawings

METAL COMPLEXES OF MANNICH BASES WITH A SCHIFF BASE

This is a continuation-in-part of copending application(s) Ser. No. 779,725 filed on Sept. 24, 1985, abandoned.

FIELD OF THE INVENTION

The present invention relates to metal reaction products of Mannich type compounds which generally do not degrade fuels and yet reduce the ignition temperature of soot as in a diesel particulate trap.

BACKGROUND

German Pat. No. 2,443,017 and corresponding U.S. Pat. No. 4,044,036 relate to one-to-one metal complexes of bis-azomethines which are useful as pigments.

Russian Pat. No. 794,015 relates to copper chelate aqua-complexes suitable as antioxidants for synthetic ester-type lubricating oils. The chelates are obtained by the reaction of the corresponding phenol Mannich base with acopper acetate in a basic medium in methyl alcohol at room temperature.

U.S. Pat. No. 3,574,837 to Pacheco et al relates to Schiff bases which are useful as fungicides.

U.S. Pat. No. 3,875,200 to L'Eplattenier et al relates to bis-azomethine pigments.

U.S. Pat. No. 3,945,933 to Chibnik et al relates to a multiple metal salt complex of an organic-substituted nitrogenous compound which can be prepared by reacting an organic compound, a polyamine containing at least two nitrogen atoms and at least two metal compounds, at least one of which is a salt capable of forming a complex with the polyamine and also capable of forming a complex with said second metal compound.

U.S. Pat. No. 3,988,323 to L'Eplattenier relates to 1:1 and 2:1 metal complexes of bis-hydrazides which are useful as pigments for high molecular weight organic materials.

U.S. Pat. No. 4,029,683 to Arantani et al relates to a process for producing an optically active alkyl chrysanthemate wherein 2,5-dimethyl-2,4-hexadiene is reacted with an alkyl diazoacetate in the presence of a copper complex coordinated with a Schiff base.

U.S. Pat. No. 4,044,036 to Hari et al relates to 1:1 metal complexes of bis-azomethines.

U.S. Pat. No. 4,093,614 to Chibnik et al relates to a multiple metal salt complex of an organic-substituted nitrogenous compound which can be prepared by reacting an organic compound, an amine containing at least two nitrogen atoms and at least two metal compounds, at least one said metal being a salt capable of forming a coordinated complex of the Werner-type with the amine and also capable of forming a complex with the said second metal compound.

SUMMARY OF THE INVENTION

Compounds useful as distillate fuel additives are produced by the reaction product of a hydroxyl- and/or thiol-containing aromatic, an aldehyde or ketone, and a hydroxyl- and/or thiol-containing amine and at least one transition metal-containing agent. This product is then reacted with a Schiff base.

DESCRIPTION OF THE PREFERRED EMBODIMENTS

The (A) hydrocarbyl-substituted hydroxyl- and/or thiol-containing aromatic compound of the present invention generally has the formula

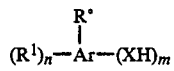

where Ar is an aromatic groups such as phenyl or polyaromatic group such as naphthyl, and the like. Moreover, Ar can be coupled aromatic compounds such as naphthyl, phenyl, etc., wherein the coupling agent is O, S, $CH_2$, a lower alkylene group having from 1 to about 6 carbon atoms, NH, and the like with $R^1$ and XH generally being pendant from each aromatic group. Examples of specific coupled aromatic compounds include diphenyl amine, diphenyl methylene and the like. The number of "m" XH groups is usually from 1 to 3, desirably 1 or 2, with 1 being preferred. The number of "n" substituted $R^1$ groups is usually from 1 to 4, desirably 1 or 2 with a single-substituted group being preferred. X is O and/or S with O being preferred. That is, if m is 2, X can be both O, both S, or one O and one S. $R^1$ can be a hydrogen or a hydrocarbyl-based substitute having from 1 to about 28 carbon atoms. As used herein and throughout this specification, the term "hydrocarbyl-based substituent" or "hydrocarbyl" denotes a substituent having a carbon atom directly attached to the remainder of the molecule and having predominantly hydrocarbyl character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the molecule (that is, any two indicated substituents may together form n alicyclic radical).

2. Substituted hydrocarbon substituents, that is, those containing non-hydrocarbon radicals which, in the context of this invention, do not alter the predominantly hydrocarbyl character of the substituent. Those skilled in the art will be aware of suitable radicals (e.g., halo, (especially chloro and fluoro), alkoxyl, mercapto, alkylmercapto, nitro, nitroso, sulfoxy, etc.).

3. Hetero substituents, that is, substituents which, while predominantly hydrocarbon in character within the context of this invention, contain atoms other than carbon present in a chain or ring otherwise composed of carbon atoms.

$R^1$ is hydrogen, or said hydrocarbyl from 1 to about 28 carbon atoms such as an alkyl, or an alkyl having from 1 to about 25 carbon atoms, more desirably from about 7 to about 20 carbon atoms, an alkenyl having 2 to about 25 carbon atoms, more desirably from about 8 to about 20 carbon atoms, a cycloalkyl having from 4 to about 10 carbon atoms, more desirably from about 5 to about 7 carbon atoms, an aromatic groups having from about 6 to about 24 carbon atoms, an aromatic-substituted alkyl or alkyl-substituted aromatic having a total of from about 7 to about 25 carbon atoms and more desirably from about 7 to about 12 carbon atoms. The hydrocarbon-based substituent preferably is an alkyl having from 7 to about 20 carbon atoms with from about 7 to about 14 carbon atoms being highly preferred. Examples of suitable hydrocarbyl-substituted hydroxyl-containing aromatics include the various naphthols, and more preferably the various alkyl-substituted cathechols, resorcinols, and hydroquinones, the various xylenols, the various cresols, aminophenols, and the like. Examples of various suitable (A) compounds include heptylphenol, octylphenol, nonylphenol, decylphenol, dodecylphenol, tetrapropylphenol, and the like. Dodecylphenol, tetrapropylphenol and heptylphenol are especially preferred. Examples of suitable hydrocarbyl-substituted thiol-containing aromatics include heptylthiophenol, octylthiophenol, nonylthiophenol, dodecylthiophenol, tetrapropylthiophenol, and the like. Examples of suitable thiol- and hydroxyl-containing aromatics include dodecylmonothioresorcinol, 2-mercaptoalkylphenol where the alkyl group is as set forth above. R° is H, an amino group or a carboxyl group with H being preferred.

The (B) compound of the present invention has the formula

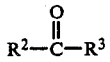

or a precursor thereof. $R^2$ and $R^3$, independently, can be hydrogen, a hydrocarbon such as an alkyl having from 1 to 18 carbon atoms and more preferably 1 or 2 carbon atoms. The hydrocarbon can also be a phenyl- or an alkyl-substituted phenyl having from about 1 to about 18 carbon atoms and more preferably from about 1 to about 12 carbon atoms. Additionally, $R^3$ can be a carbonyl or a carboxyl-containing hydrocarbon where the hydrocarbon is as described immediately above. Examples of suitable (B) compounds include the various aldehydes and ketones such as formaldehyde, acetaldehyde, propionaldehyde, butyraldehyde, valeraldehyde, benzaldehyde, and the like, as well as methyl ethyl ketone, dimethyl ketone, ethyl propyl ketone, butyl methyl ketone, glyoxal, glyoxylic acid and the like. Precursors of such compounds which react as aldehydes under reaction conditions of the present invention can also be utilized and include paraformaldehyde, trioxane, formalin and the like. Formaldehyde and its polymers, for example, paraformaldehyde are preferred. Nautrally, mixtures of the various (B) reactants can be utilized.

It is an important aspect of the present invention to utilize a (C) hydroxyl- and/or thiol-containing amine compound wiht the hydroxyl-containing compound being preferred. The amino group is desirably a primary amine or a secondary amine. Generally, the thiol- and/or hydroxyl-containing amine compound has from about 1 to about 10 primary or secondary amine groups therein from about 1 to about 10 thiol groups therein, and from about 1 to about 10 hydroxyl groups therein. Desirably, such a compound contains one or two amine groups as well as one or two thiol groups and one or two hydroxyl groups therein. Representative examples of thiol-containing amine compounds include 2-mercaptoethyl amine, N-(2-mercaptoethyl)ethanol amine and the like.

The preferred hydroxyl-containing amine compound can be a cyclohydrocarbyl hydroxyl-containing amine, a compound having the formula

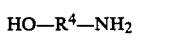

or a compound having the formula

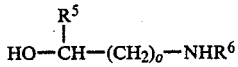

The cyclohydrocarbyl compound can contain from 1 to 10 hydroxyl groups, and preferably one or two. Desirably the hydroxyl group is pendant from the ring structure. The number of amino groups is from about 1 to about 10 with one amino group being preferred. The amino group is also desirably pendant from the ring structure. The number of carbon atoms in the cyclohydrocarbyl group is from 3 to 30, with a cycloalkyl having from 3 to 6 being preferred. Examples of such cyclohydrocarbyl hydroxyl-containing amines include 2-aminocyclohexanol and the like.

In the compound having the formula

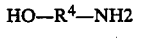

$R^4$ is a hydrocarbylene having from 1 to 20 carbon atoms. $R^4$ can be linear, branches, and the like. Desirably, $R^4$ is an alkylene having from 2 to about 6 carbon atoms, and preferably has 2 or 3 carbon atoms.

Considering $R^5$ of the formula

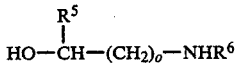

it is hydrogen or a hydrocarbyl having from 1 to about 20 carbon atoms. $R^5$ can be linear, branched, or the like. Desirably, $R^5$ is alkyl having from 1 to about 20 carbon atoms and more desirably from 1 to about 2 carbon atoms. Preferably, $R^5$ is a hydrogen atom.

The number of repeating units, that is "o" is 1 to 10 with 1 being preferred. $R^6$ is a hydrogen atom, a hydroxyl-containing hydrocarbyl primary amino group having from 1 to about 20 carbon atoms or a hydrocarbyl polyamino group having from 1 to about 20 carbon atoms. Desirably, the hydroxyl-containing hydrocarbyl group is an alkyl containing from 1 to 20 carbon atoms, desirably 2 or 3 carbon atoms with 2 carbon atoms being preferred. Desirably, the hydrocarbyl-containing amino group is an alkyl amino groups such as a primary amino group containing from 1 to 20 carbon atoms, more desirably 2 or 3 carbon atoms with 2 carbon atoms being preferred. The hydrocarbyl-containing polyamino group desirably is an alkyl group containing from 1 to 20 carbon atoms, more desirably 2 or 3 carbon atoms with 2 carbon atoms preferred. This compound can contain a total of 1 to 10 amino groups with 1 or 2 amino groups being preferred. Taken together, $R^5$ and $R^6$ has a total number of 24 carbon atoms or less.

Examples of said (C) hydroxyl-containing amine compunds include both mono- and polyamines provided that they contain at least one primary or secondary amino group. Examples of specific hydroxyl-containing amines include ethanolamine, di-(3-hydroxypropyl)amine, 3-hydroxybutylamine, 4-hydroxybutylamine, diethanolamine, di-(2-hydroxypropyl)amine, N-(hydroxypropyl)propylamine, N-(2-hydroxyethyl)cyclohexylamine, 3-hydroxycyclopentylamine, N-hydroxyethyl piperazine, and the like. Examples of suitable amino alcohols include the N-(hydroxy-lower alkyl)amines and polyamines such as 2-hydroxyethylamine, di-(2-hydroxyethyl)amine, and N,N,N'-tri-(2-hydroxyethyl)ethylenediamine.

Also contemplated are other mono- and poly-N-hydroxy alkyl-substituted alkylene polyamines; especially those containing 2 to 3 carbon atoms in the alkylene radicals and alkylene polyamines containing up to 7 amino groups such as the reaction product of about 2 moles of alkylene oxide and 1 mole of diethylenetriamine.

Amino alcohols containing primary amines as set forth in the above formula containing $R^4$ are described in U.S. Pat. No. 3,576,743 and is hereby fully incorporated by reference. Specific examples of hyroxy-substituted primary amines include 2-amino-1-butanol, 2-amino-2-methyl-1-propanol, 2-amino-1-propanol, 3-amino-1-propanol, 2-amino-2-methyl-1,3-propanediol, 2-amino-2-ethyl-1,3-propanediol, N-(beta-hydroxypropyl)-N'-beta-aminoethyl)piperazine, tris(hydroxymethyl)amino methane (also known as trismethylolaminomethane), 2-amino-1-butynol, ethanolamine, beta-(beta-hydroxyethoxy)-ethylamine, glucamine, glucosamine, 4-amino-3-hydroxy-3-methyl-1-butene (which can be prepared according to procedures known in the art by reacting isoprene oxide with ammonia, N-(3-aminopropyl)-4-(2-hydroxyethyl)-piperazine, 2-amino-6-methyl-6-heptanol, 5-amino-1-pentanol, N-(beta-hydroxyethyl)-1,3-diaminopropane, 1,3-diamino-2-hydroxy-propane, N-(beta-hydroxy ethoxyethyl)-ethylenediamine, and the like. For further description of the hydroxy-substituted primary amines contemplated as being useful as (C), U.S. Pat. No. 3,576,743 is expressly incorporated herein by reference for its disclosure of such amines.

The (D) agent of the present invention contains a transition metal, that is, a metal found in Cols. 1B, 2B, 5B through 7B, and Col. 8 of the Periodic Table as set forth in *The Handbook of Chemistry and Physics*, 61st Edition, CRC Press, Inc., 1980–1981. Any salt of a transition metal can be utilized. Thus, salts of carbonates, sulfates, nitrates, halogens as for example chlorides, oxides, hydroxides, combinations thereof and the like can be utilized. Such salts are known to the art as well as to the literature. Desirable transition metals include copper, iron, zinc and manganese. Additionally, various oil-soluble salts can be utilized such as those derived from naphthenates and various carboxylates. That is, the salts can be derived from the reaction of the transition metals with soaps or fatty acids, saturated or unsaturated. The fatty acids generally have from about 8 to about 18 carbon atoms. An additional salt are the metal esters wherein the esters are lower aliphatic and desirably lower alkyl having from about 1 to about 7 carbon atoms. Examples of specific transition metals containing salts include zinc oxide, basic copper carbonate (also referred to as copper hydroxy carbonate), copper acetate, copper bromide, copper butyrate, copper chloride, copper nitrate, copper oxide, copper palmitate, copper sulfate, iron acetate, iron bromide, iron carbonate, iron chloride, iron hydroxide, iron nitrate, iron sulfate, manganese acetate, manganese bromide, manganese chloride, manganese sulfate, and the like. Preferred (D) agents include basic copper carbonate and copper acetate.

The preparation of the metal complexes of hydroxyl-containing Mannich compounds can be carried out by a variety of methods such as in a single pot or a two-pot preparation. The one-pot method briefly relates to adding the (A) hydroxyl-containing aromatic compound, the (B) saturated aldehyde or ketone, and (C) the hydroxyl- and/or thiol-containing amine compound to a suitable vessel and heating to carry out the reaction. Reaction temperatures from about ambient to about the decompostion temperature of the Mannich can be utilized. During reaction, water is drawn off as by sparging. Desirably, the reaction is carred out in solvent such as an aromatic-type oil. The amount of the various reactants utilized is desirably on a mole-to-mole basis of (A) and (B) for each (C) secondary amino group or on a two-mole basis of (A) and (B) for each (C) primary amino group, although larger or smaller amounts can also be utilized as set forth hereinbelow. The (D) compound containing at least one transition metal is then added, typically in a slow manner since the reaction may be exothermic as well as to control foaming. The reaction by-products such as carbon dioxide and water are removed via suitable procedure such as sparging, usually at a temperature greater than the boiling water. However, the temperature is usually less than 150° C. inasmuch as the metal complex formed may be unstable at higher temperatures.

The "two-pot" method is basically as set forth below although various modifications thereof can be practiced. The hydroxy-containing aromatic compound (A) and the hydroxyl- and/or thiol-containing amine compound (C) are added to a reaction vessel. The aldehyde or ketone (B) is generally rapidly added and the exothermic reaction generated is supplemented by mild heat such that the reaction temperature is from about 60° C. to about 90° C. Desirably, the addition temperature is less than the boiling point of water, otherwise, the water will bubble off and cause processing problems. After the reaction is essentially complete, the water by-product is removed in any conventional manner as by evaporation thereof which can be achieved by applying a vacuum, applying a sparge, heating or the like. A nitrogen sparge is often utilized at a temperature of from about 100° C. to about 130° C. Naturally, higher or lower temperatures can be utilized.

The reaction is generally carried out in a solvent. Any conventional solvent can be utilized such as toluene, xylene or propanol. Often times various oils are utilized such as an aromatic type oil, 100 neutral oil, etc.

The amount of the various (A), (B) and (C) components is as set forth above. However, it is to be understood that larger or smaller amounts can be utilized. For example, for each primary amino group of (C) from about 0.5 to about 6 moles of (A) and (B) can be utilized and more desirably from about 1.8 to about 2.2 moles of (A) and (B). For each secondary amino group of (C), from about 0.2 to about 2 moles of (A) and (B) can be utilized and more desirably from about 0.9 to about 1.1 moles of (A) and (B).

The next step is the reaction of at least one transition metal containing agent (D) to form a Mannich complex. Desirably, a promoter is utilized in association with the metal-containing compound to free the metal so that it can react with the above reaction product. The promoter alternatively can be added before or after the metal addition. Since the formation of the metal complex may be exothermic, the metal-containing compound is generally added in a slow manner, for example, dropwise, to control foaming produced by the evolution of carbon dioxide as well as the formation of water. Alternatively, the metal-containing compound and the promoter can be mixed in an appropriate solvent and the Mannich complexing material can then be added to this mixture. Generally this reaction step is carried out at a temperature of from about room temperature to about 90° C. After sufficient time has elapsed such that the reaciton is generally complete, water and any remaining carbon dioxide is removed by conventional methods such as by sparging at temperatures below that which renders the metal complex unstable. The unstable temperature of the various metal complexes will vary depending upon the type of compound with a guideline being appoximately 150° C. Thus, sparging is generally kept below 130° C. and often under 120° C.

As noted above, promoters are often desirable to improve the rate of reaction of the metal-containing compound. A basic promoter is desirable such as ammonium hydroxide. Generally, any conventional aqueous basic salt can be utilized which is known to the art and the literature with specific examples being potassium hydroxide, sodium hydroxide, sodium carbonate, and the like with ammonium hydroxide being preferred. The amount of promoter generally varies with regard to the type of metal as known to those skilled in the art.

The metal complex Mannich compounds of the present invention generally do not degrade fuels and hence can be utilized in many applications. A particularly suitable use is as a diesel fuel additive. Upon utilization, that is, during combustion, all the organic portions of the metal complex Mannich compound are essentially burned. The remaining metal portion of the compound has been found to reduce the ignition temperature of soot. Thus, soot is much more readily broken down or reacted at lower temperatures as in a particulate soot trap which is often utilized in association with diesel engines.

The final step is the reaction of a Schiff base (E) with the above metal Mannich complex. The use of Schiff bases are desirable in that they help complex or chelate various metals such as copper.

A desirable type of a Schiff base utilizing the present invention is set forth by the following formula

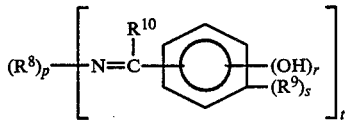

$R^8$ can be hydrogen or a hydrocarbyl having from 1 to about 20 carbon atoms such as an alkyl having from 1 to 20 carbon atoms with hydrogen or methyl being preferred. $R^8$ can also be an alkyl amine, diamine, or polyamine, having from 1 to about 20 carbon atoms open chain or cyclic and up to 7 nitrogen atoms, or an aromatic such as phenyl, naphthyl, etc., or an alkyl-substituted aromatic having a total number of from about 6 to about 36 carbon atoms with from about 6 to about 12 carbon atoms being preferred. The number of such $R^8$ groups, that is, p, is 1 or 2 with 1 such group being preferred. Similarly, the number of hydroxyl groups as represented by r is 1 or 2 with 1 such group being preferred. $R^9$, independently, can be a hydrogen or a hydrocarbyl having from 1 to 20 carbon atoms such as an alkyl having from 1 to 20 carbon atoms, desirably an alkyl having from 1 to 6 carbon atoms with hydrogen being preferred. $R^9$ can also be an aromatic or an alkyl-substituted aromatic having a total number of from 6 to about 36 carbon atoms and desirably from 6 to about 12 carbon atoms therein. The number of such $R^9$ groups, that is s is 1 or 2 with 1 such group being preferred. $R^{10}$ is hydrogen or a lower alkyl, that is, having from 1 to about 8 carbon atoms, with hydrogen being preferred. The number of groups within the Schiff base is represented by t is from 1 to 6 with 2 such groups being preferred. Representative examples of such Schiff bases include N-N'-disalicylidene-1,2-propanediamine, N-salicylideneaniline, N,N'-disalicylideneethylenediamine, salicylal-beta-N-aminoethylpiperazine and the like.

The amount of said Schiff base is from about ¼ to about 4 gram atoms of nitrogen as imine groups per gram atom of said metal in said reaction product and more desirably from about ½ to about 3 gram atoms. The Schiff base is blended with the metal Mannich complex simply by mixing therewith as an ambient temperature. Schiff bases of the type set forth above are known to the art and are generally commercially available.

The metal Mannich complexes of the present invention in combination with the Schiff base are often prepared as a concentrate for later addition to the fuel. When utilized as a concentrate, the concentrate solution may also contain dispersants and substantially inert organic liquid diluents known to the art and to the literature. Examples of suitable dispersants include succinimides and the like. Suitable inert organic liquid diluents which generally do not react with the metal Mannich complex and/or Schiff base include various aliphatic and aromatic hydrocarbons such as naphthenic stocks, kerosene, textile spirits, benzene, toluene, xylene, alcohols such as isopropanol, n-butanol, isobutanol and 2-ethylhexanol, ether such as ethylene or diethylene cycloalkyl mono- or diethyl ether, mineral oil, synthetic oils and the like. Preferred diluents include mineral oil and aromatic naphtha. Although other additives can be utilized in the concentrate, the above additives are desired. The amount of the metal Mannich complex with the Schiff base utilized in the concentrate is generally from about 10 to 99 weight percent with about 25 to about 75 weight percent being preferred.

The metal Mannich complex with the Schiff base is generally utilized as an additive for various fuel compositions. Such fuel compositions have varying boiling ranges, viscosities, cloud and pour points, etc., according to their end use as is well known to those skilled in the art. Among such fuels are those commonly known as diesel fuels, distillate fuels, heating oils, residual fuels, bunker fuels, and the like. The properties of such fuels are well known to the art as illustrated, for example, by ASTM Specifications D 396-73. As noted above, a preferred use is in association with diesel fuels wherein good stability is achieved with reduced ignition temperatures of soot. The amount of reaction product of the present invention with the Schiff base in such fuels is from about one part to about 500 parts by weight of metal per one million parts by weight of said fuel and more desirably from about 15 parts to about 200 parts by weight.

The following examples describe specific preparations of compounds of the present invention.

EXAMPLE 1

A 12-liter, 4-neck flask with mechanical stirrer, thermowell, thermometer, nitrogen sparge, H-trap, and condenser is charged with dodecyl phenol (3240 grams), hydro-refined naphthenyl oil (2772 grams) and ethanolamine (380 ml.). The mixture is stirred and heated to 72° C. and paraformaldehyde (372 grams) is rapidly charged thereto. The reaction temperature is increased to a maximum of 147° C. over a 3-hour period while sparging out water with nitrogen. A total of 218 ml. of water is collected versus a theoretical amount of 230 ml. At 25° C., $Cu_2(OH)_2CO_3$ (663 grams) is then charged to the flask. The solution is warmed to 63° C. and aqueous ammonia (782 ml.) is added. The reactants are warmed while sparging out water ($N_2$ at 1.0 SCFH). The maximum temperature achieved over a period of 8.5 hours is 122° C. The amount of water collected is 648 ml. theoretical amount of 662. The reactants are then cooled and filtered and the desired product obtained. Yield is 6593 grams versus a theoretical amount of 6930 grams, that is, 95%.

EXAMPLE 2

A 12-liter, 4-neck flask equipped with a mechanical stirrer, thermowell, thermometer, nitrogen sparge, H-trap, and condenser is charged with dodecyl phenol (3240 grams), an aromatic low boiling naphthenic solvent (2500 grams) and ethanolamine (362 ml.). The reactants are stirred and heated to 70° C. and paraformaldehyde (372 grams) is charged rapidly to the solution. The solution is gradually heated while sparging with nitrogen. Maximum reaction temperature reached is 137° C. over a 5-hour period. 230 ml. of aqueous solution is collected. The reaction mixture is cooled to 30° C. and charged with aqueous ammonia (391 ml.). With the heat source shut off, $Cu_2(OH)_2CO_3$ (663 grams) is gradually added over a 30-minute period. During the $Cu_2(OH)_2CO_3$ addition, the reaction gives an exotherm of about 30°–47° C. The reaction temperature is then increased to about 70° C. with additional aqueous ammonia (95 ml.) being rapidly charged. The solution temperature is gradually increased to collect water in the trap over a 14.5-hour period with a maximum temperature of about 121° C. A total of 536 ml. of water is collected versus a theoretical amount of 537 ml. The solution is cooled and filtered. A yield of 93% is achieved.

EXAMPLE 3

A 2-liter, 4-neck flask equipped with a mechanical stirrer, nitrogen sparge, H-trap, condenser and addition funnel is charged with 928 grams of a Mannich material as prepared in Example 1. The solution is heated to about 55° C. and $Cu_2(OH)_2CO_3$ is charged to the flask (no $CO_2$ evolution). When the temperature reached 60° C., aqueous ammonia is added over a 15-minute period. The temperature is gradually increased to a maximum of 120° C. over a 5-hour period while sparging. A total of 85 ml. of water is collected in the trap versus a theoretical amount 88 ml. The reaction product is filtered and a yield of 90% is achieved.

EXAMPLE 4

A 2-liter, 4-neck flask equipped with mechanical stirrer, thermowell, H-trap and condenser is charged with dodecyl phenol (900 grams), mixed xylenes (300 grams) and ethanolamine (105 grams). The mixture is stirred and heated to 70° C. and paraformaldehyde is added rapidly to the reaction. The reaction is then heated to 150° C. and water is removed through the H-trap. After the water is collected, the reaction is cooled to 120° C. and filtered. The filtrate is the Mannich.

A 1-liter, 4-neck flask equipped with thermowell, mechanical stirrer, H-trap, and condenser is charged with basic copper carbonate (50 grams), isopropyl alcohol (200 milliliters) and ammonium hydroxide (100 milliliters). This mixture is heated to 60° C. and 353 grams of the above Mannich material is added to the flask. The reaction is heated to reflux the solvents and held for 3 hours. The material is then stripped of solvents and water at 135° C. with an aspirator vacuum of 18 mm. Hg. During the stripping the reaction is diluted with a naphthenic oil (220 grams). The flask contents are filtered and a yield of 92% is obtained; 481 grams versus a theoretical yield of 523 grams.

EXAMPLE 5

A 2-liter, 4-neck flask equipped with a mechanical stirrer, thermowell, H-trap and condenser is charged with dodecylphenol (900 grams), mixed xylenes (300 grams) and 50% aqueous NaOH (1 gram). The reaction is heated while stirring to 60° C. and charged with 53 grams paraformaldehyde. The flask is then heated to 110° C. for 1 hour until all paraformaldehyde is reacted. The material is further heated to 150° C. and $H_2O$ is removed. Formic acid is then added to neutralize the NaOH catalyst. Reaction is cooled to 60° C. and diethanolamine and paraformaldehyde is charged successively. After addition is completed, the reaction is heated to a maximum of 135° C. and water is collected in the H-trap. When the reaction is completed, the material is cooled and filtered. The filtrate is the desired Mannich material.

In a 1-liter, 4-neck flask equipped with mechanical stirrer, thermowell and condenser, basic copper carbonate (50 grams), isopropyl alcohol (200 milliliters) and ammonium hydroxide (150 milliliters) is charged. This solution is heated to 38° C. and 425 grams of the above Mannich material is added to the stirring reaction. The Mannich is refluxed for 5 hours and then solvents, water and ammonium hydroxide are removed by stripped with aspirator vacuum (21 mm. Hg.) at 120° C. The reaction is diluted with naphthenic oil (300 grams) during stripping. The reaction is then cooled and filtered and 723 grams of product is obtained out of a theory of 752 grams. The yield is 96%.

The Schiff base is added thereto simply by blending it therewith as at ambient temperatures. In some instances, the Schiff base is not soluble with the reaction product. In these situations, the Schiff base is usually independently added to the fuel.

Various reaction products prepared in the manner as set forth above were made and tested. A 1983 General Motors Cutlass Ciera 4.3-liter V-6 diesel engine on a chassie dynamometer is utilized. The conditions simulated are 40 m.p.h., a road load of 1.5, a test duration of 3 hours and fuel rate of 1.3 grams per second. A Corning filter trap product code 433347-3 is attached to the exhaust system of the engine. After the test, the particulates are removed from the trap by sawing one inch off the exhaust end of the trap. The particles are collected by pushing the same from the trap inlet end towards the exhaust end. The particulates are then transferred to a thermal gravimetric analyzer for determination of ignition temperature. The particulate ignition temperature response is as set forth in the following table.

| Particulate Ignition Temperature Response | | |
|---|---|---|
| Metallic | Concentration ppm, wt/wt | Ignition Temperature Reduction °C. |
| Cu (A)* | 123 | 255 |

-continued

| Particulate Ignition Temperature Response | | |
|---|---|---|
| Metallic | Concentration ppm, wt/wt | Ignition Temperature Reduction °C. |
| Cu (B)** | 123 | 250 |

*Dodecylphenol/$(CH_2O)_x$/Ethanolamine (2:2:1)m/$Cu_2(OH)_2CO_3/NH_3$(ag) (IN:-1Cu:2N)
**Cu(A)/N—N'—disalicylidene-1,2-propane diamine The fuel utilized was a conventional fuel such as DDR-366 distributed by the Howell Hydrocarbon Company and the various reactants were made in the manner as set forth in Example 2.

As apparent from the above table, significant ignition temperature reductions were obtained, especially with copper-containing compounds.

General Screening tests were made as for example a 90-minute, 300° F. fuel oil accelerated stability test. This test is generally an accepted test known to the art and is also known as a Sante Fe Railroad Test, Union Pacific Railroad Test, A Nalco or a DuPont Test. The test purpose, outlined, materials and procedure are as follows:

Purpose:

To determine the resistance of fuel oil to degradation in storage. Heat and exposure to air are substituted for storage time. The effectiveness of fuel stabilizers can be evaluated by this method.

Outline:

A 50 ml. portion of the fuel oil in a test tube is heated at 300° F., and the ASTM color is determined before and after the test. In addition, the fuel i filtered through filter paper, and the stain is compared with standard stains.

Materials:

1. 3×20 cm. Pyrex test tubes
2. Oil bath set at 300° F.—Dow Corning DC 200 Fluid stirred and themostatically controlled
3. Suction flask
4. No. 1 Whatman filter pads (4.2 cm. dia.)
5. Heptane or Iso-octane
6. Colorimeter (ASTM)
7.1 Standard set of filter pads (Nalco rating system, 0.20)
8. Millipore filter apparatus Procedure:

1. Some fuels are tested on an "as received" basis and some are prefiltered through Whatman No. 1 filter paper on the day of the test.
2. All fuels are saturated with air by gentle bubbling for 2 minutes just before the start of the test.
3. The test fuel is placed in a 3×20 cm. Pyrex test tube and the original color and filter pad ratings of the sample are determined.
   a. The ASTM color is determined.
   b. The filter pad rating is determined by vacuum filtration of a 50 ml. sample of the oil through two No. 1 Whatman filter papers. Suction is applied only after the sample is in the Millipore filter. Two filter papers are used so that the sediment being collected is uniformly dispersed on the top paper.
4. The filter pad is then washed with heptane or iso-octane, air-dried, and the top paper is rated by comparing it to the standard set of filter pads numbered 1 to 20. The bottom paper is discarded.
5. After the preliminary work is completed, 50 ml. of each treated oil sample in 3×20 cm. test tubes is placed in a 300° F. oil bath. An untreated (blank) sample is to be included.
6. After 90 minutes (or 5 hours if specified) the samples are removed from the oil bath and are allowed to cool to room temperature for 1 hour in the dark.
7. When cool, each sample test tube is wiped dry and the color is determined. Each 50 ml. sample is then filtered as above (3b), and rated (4).
8. The final color and filter pad ratings are compared to the original color and filter pad ratings to evaluate the degrees of degradation.
9. The stain on the inside of the tube is recorded as None, Light, Medium or Heavy.

Various compositions were made and tested and the results thereof are set forth within Table A.

Table A relates to a test wherein one of the compositions contained a Schiff base.

TABLE A

| Base Fuel = No. 2 Fuel Oil 90-min/300° F. Stability | | | | |
|---|---|---|---|---|
| Treatment Level/ppm | Additive | ASTM Initial | Color Final | ASTM D-2274 Tot. Insol. mg/100 ml. |
| A | None | L2.0 | L2.5 | 0.32 |
| B 513 | Cu Cem All (12% Cu)(Mooney) | L3.0 | L5.5 | (10%)* |
| C 1404 | Copper Mannich Compound of Ex. 3 | L3.0 | L3.5 | (30%)* |
| D 1404 | Copper Mannich Compound of Ex. 3 366 N,N'—disalicyl-idene-1,2-propane-diamine | L3.5 | L5.0 | 0.25 |

*Percent of sample filtered before pluggage.

As apparent from Table A, compound B caused severe degradation of the base fuel. The copper Mannich compound of the present invention when added produced a stable fuel, compound C. A further improvement is achieved when a Schiff base is utilized, compound D.

Table B relates to a 13-week storage stability test.

TABLE B

| 110° F./13-Week Storage Stability | | | | |
|---|---|---|---|---|
| | | ASTM D-1500 Color Ratings | | ASTM D-2274 Insol. Residue |
| Additive Treatment | | Initial | Final 13-wks. | Rating Residue mg/100 ml. |
| AA | No Additive | L2.0 | L2.5 | 0.23 |
| BB | Copper Cem-All (Mooney) 0.2 g. Cu/Gal. | L3.0 | L5.0 | 68.41 |
| CC | 1234 ppm Copper Mannich Compound of Ex. 4 | L3.0 | L5.0 | 3.12 |
| DD | 1493 ppm Copper Mannich Compound of Ex. 5 | L1.5 | L4.0 | 10.78 |
| EE | 1234 ppm Copper Mannich Compound of Ex. 4. 366 ppm N—N'—dis-alicyl idene-1,2-propanediamine | L4.5 | L5.5 | 0.76 |
| FF | 1493 ppm Copper Mannich of Ex. 5 366 ppm N,N'—dis-alicyl idene-1,2-propanediamine | L4.5 | L5.5 | 0.75 |

As apparent from Table B, compound BB caused sever degradation of the base fuel. The copper Mannich compound CC and DD improved fuel stability. Compounds EE and FF further improved fuel stability.

While in accordance with the patent statutes, a best mode of preferred embodiment has been set forth in detail, the scope of the invention is not limited thereby, but rather by the scope of the attached claims.

What is claimed is:

1. The reaction product of:

(A) a compound having the formula

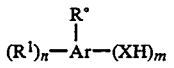

wherein Ar is an aromatic group or a coupled aromatic group, wherein m is 1, 2 or 3, wherein n is an integer from 1 to 4, wherein $R^1$ independently, is hydrogen or a hydrocarbyl having from 1 to about 100 carbon atoms, wherein R° is H, amino or carboxyl, and wherein X is O, S, or both when m is 2 or greater;

(B) a compound having the formula

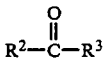

or a precursor thereof wherein $R^2$ and $R^3$, independently, is hydrogen, a hydrocarbon having from 1 to about 18 carbon atoms, or wherein $R^3$ is a carbonyl or a carboxyl-containing hydrocarbon having from 1 to 18 carbon atoms;

(C) a hydroxyl-containing amine compound, a thiol-containing amine compound, or a hydroxyl-thiol-containing amine compound containing from about 1 to about 10 primary or secondary amine groups therein, from about 1 to about 10 thiol groups therein, and from about 1 to about 10 hydroxyl groups therein; with at least one (D) transition metal containing agent in the molar ratio of A:B:C:D of from about 0.5–6:0.5–6:1.0:0-5–2 when C is a primary amine compound and from about 0.2–2:0.2–2:1.0:0.2–2 when C is a secondary amine compound, and (E) an effective amount of a Schiff base of the formula:

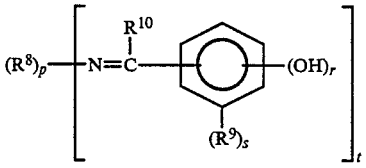

wherein p is 1 or 2, wherein $R^8$ is hydrogen, a hydrocarbyl having from 1 to about 20 carbon atoms, or an alkyl amine, diamine or polyamine haing from 1 to 20 carbon atoms, wherein s is 1 or 2, wherein $R^9$, independently, is hydrogen or a hydrocarbyl having from 1 to about 20 carbon atoms, wherein r is 1 or 2, wherein $R^{10}$ is hydrogen or lower alkyl, and wherein t is 1 to 6.

2. The product of claim 1 wherein $R^1$ of said (A) compound is hydrogen, or an alkyl having from 1 to about 30 carbon atoms, a cycloalkyl having from 4 to about 10 carbon atoms, an alkenyl having from 2 to about 30 carbon atoms, an aromatic or an alkyl-substituted aromatic having from about 7 to about 30 carbon atoms or an aromatic-substituted alkyl having from about 7 to about 30 carbon atoms, and wherein said Ar is coupled with a coupling agent and wherein said coupling agent of said coupled Ar group is O, S, NH or a lower alkylene.

3. The product according to claim 2 wherein said (C) compound is said hydroxyl-containing amine having from 1 to about 10 hydroxyl groups therein and from 1 to about 10 amine groups therein, or said hydroxyl-thiol-containing amine having from 1 to about 10 hydroxyl groups therein, from 1 to about 10 thiol groups therein and from 1 to about 10 amine groups therein; wherein $R^2$ and $R^3$ of said (B) compound, independently, is hydrogen, an alkyl phenyl or an alkyl-substituted phenyl wherein said alkyl contains from 1 to 18 carbon atoms or $R^3$ is a carboxyl-containing alkyl wherein said alkyl has from 1 to 18 carbon atoms.

4. The product of claim 3 wherein said (C) hydroxyl-containing amine is a compound having the formula

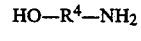

or a compound having the formula

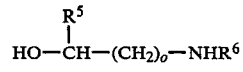

or a cyclohydrocarbyl hydroxyl-containing amine having from 3 to 20 carbon atoms wherein $R^4$ is a hydrocarbylene having from 1 to about 20 carbon atoms, wherein $R^5$ is hydrogen or a hydrocarbyl having from 1 to about 20 carbon atoms, wherein o is an integer of from 1 to 10, wherein $R^6$ is hydrogen, a hydroxyl containing hydrocarbyl having from 1 to about 20 carbon atoms, a hydrocarbyl primary amine having from 1 to about 20 carbon atoms, or a hydrocarbyl polyamine having from 1 to about 20 carbon atoms, and wherein the total number of $R^5$ and $R^6$ carbon atoms is 24 or less.

5. The product of claim 4 wherein Ar of said (A) compound is phenyl, wherein m is 1 or 2, wherein n is 1 or 2, wherein n is 1 or 2, wherein R° is H, wherein $R^1$ is an alkyl having from about 7 to about 20 carbon atoms, a cycloalkyl having from about 5 to about 7 carbon atoms, an alkenyl having from about 8 to about 20 carbon atoms, or an alkyl-substituted aromatic having from 7 to about 12 carbon atoms, wherein said (D) metal of said transition metal-containing agent is copper, iron, zinc, manganese, or combinations thereof.

6. The metal product of claim 5 wherein $R^4$ of said (C) hydroxyl-containing amine is an alkylene having from 2 to about 6 carbon atoms, wherein $R^5$ is hydrogen or an alkyl having from 1 to about 20 carbon atoms, and $R^6$ is hydrogen, a hydroxyl-containing alkyl having from 1 to about 20 carbon atoms, an alkyl primary amine having from to about 20 carbon atoms, or an alkyl polyamine having from 1 to about 20 carbon atoms, and wherein said cyclohydrocarbyl hydroxyl containing amine is a cycloalkyl hydroxyl containing amine having from 3 to about 6 carbon atoms.

7. The product of claim 6 wherein m of of said (A) compound is 1, wherein n is 1 or 2, wherein $R^1$ is an alkyl having from about 7 to about 20 carbon atoms, and wherein X is O, and wherein $R^2$ and $R^3$ of said (B) compound is hydrogen.

8. The product of claim 7 wherein $R^4$ of said (C) hydroxyl-containing amine is an alkylene having 2 or 3 carbon atoms, wherein $R^5$ is hydrogen, or an alkyl having 1 or 2 carbon atoms, wherein o is 1, and wherein $R^6$ is a hydroxyl-containing alkyl having 2 or 3 carbon atoms, an alkyl primary amine having 2 or 3 carbon atoms, or an alkyl polyamine having 2 or 3 carbon atoms.

9. The product of claim 8 wherein said (D) metal of said transition metal-containing agent is copper, and said (C) hydroxyl-containing amine compound is ethanolamine or diethanolamine.

10. The product of claim 1 wherein the amount of said Schiff base (E) is from about $\theta$ to about 4 gram atoms of nitrogen as imine groups per gram atom of said metal in said reaction product.

11. The product of claim 10 wherein the amount of said Schiff base (E) if from about ½ to about 3 gram atoms of nitrogen as imine groups per gram atom of said metal in said reaction product, wherein p is 1, wherein $R^8$ is a primary alkyl amine having from 1 to 20 carbon atoms, wherein s is 1, wherein $R^9$ is hydrogen or an alkyl having from 1 to about 6 carbon atoms, wherein $R^{10}$ is hydrogen, wherein r is 1, and wherein t is 2.

12. A fuel composition comprising a major amount of a fuel and a minor amount of the product of claim 1.

13. A fuel composition comprising a major amount of a fuel and a minor amount of the product of claim 8.

14. A fuel additive for reducing the ignition temperature of soot from an exhaust gas comprising the composition of claim 1.

15. A fuel additive for reducing the ignition temperature of soot from an exhaust gas comprising the composition of claim 7.

16. A fuel additive for reducing the ignition temperature of soot from an exhaust gas comprising the composition of claim 10.

17. A fuel additive concentrate comprising: an organic solvent, and from about 10% to about 99% by weight of the composition of claim 1.

18. A fuel additive concentrate comprising: an organic solvent, and from about 10% to about 99% by weight of the composition of claim 3.

19. A fuel additive concentrate comprising: an organic solvent, and from about 10% to about 99% by weight of the composition of claim 4.

20. A fuel additive concentrate comprising: an organic solvent, and from about 10% to about 99% by weight of the composition of claim 7.

21. A fuel additive concentrate comprising: an organic solvent, and from about 10% to about 99% by weight of the composition of claim 9.

22. A fuel additive concentrate comprising: an organic solvent, and from about 10% to about 99% by weight of the composition of claim 10.

23. A fuel additive concentrate comprising: an organic solvent, and from about 10% to about 99% by weight of the composition of claim 11.

* * * * *